US006983249B2

(12) United States Patent
Sakai

(10) Patent No.: US 6,983,249 B2
(45) Date of Patent: Jan. 3, 2006

(54) SYSTEMS AND METHODS FOR VOICE SYNTHESIS

(75) Inventor: Hideo Sakai, Yokohama (JP)

(73) Assignee: International Business Machines Corporation, Armonk, NY (US)

( * ) Notice: Subject to any disclaimer, the term of this patent is extended or adjusted under 35 U.S.C. 154(b) by 762 days.

(21) Appl. No.: 09/891,717

(22) Filed: Jun. 26, 2001

(65) Prior Publication Data

US 2002/0055843 A1 May 9, 2002

(30) Foreign Application Priority Data

Jun. 26, 2000 (JP) ..... 2000-191573

(51) Int. Cl.
*G10L 13/00* (2006.01)

(52) U.S. Cl. ..... 704/258; 704/260; 704/270

(58) Field of Classification Search ..... 704/260, 704/270, 258; 705/26
See application file for complete search history.

(56) References Cited

U.S. PATENT DOCUMENTS 5,950,163 A * 9/1999 Matsumoto ..... 704/260
6,134,533 A * 10/2000 Shell ..... 705/26
6,269,336 B1 * 7/2001 Ladd et al. ..... 704/270
6,324,511 B1 * 11/2001 Kiraly et al. ..... 704/260

FOREIGN PATENT DOCUMENTS

| | | |
|---|---|---|
| JP | PUPA 05-233565 | 9/1993 |
| JP | PUPA 09-090970 | 4/1997 |
| JP | PUPA 09-171396 | 6/1997 |
| JP | PUPA 10-191036 | 7/1998 |
| JP | PUPA 11-215248 | 8/1999 |
| WO | WO 98/20672 | 10/2001 |

* cited by examiner

*Primary Examiner*—W. R. Young
*Assistant Examiner*—Huyen X. Vo
(74) *Attorney, Agent, or Firm*—Ference & Associates

(57) ABSTRACT

Systems and methods for voice synthesis are disclosed for providing a synthesized voice message that is consonant with the taste of a customer and a program storage device readable by machine to perform method steps for voice synthesis. In accordance with an order from a customer received via a network, a service provider generates voice synthesis data, based on voice characteristic data for a speaker chosen by the customer, that is produced for a sentence input by the customer, and prepares to deliver the voice synthesis data to the customer. At this time, a transaction number is provided for the order received from the customer, and subsequently, when the transaction number is presented by the customer, the generated voice synthesis data are delivered to the customer. The customer then loads the received voice synthesis data into a device that reproduces the voiced sentence.

15 Claims, 7 Drawing Sheets

SYSTEMS AND METHODS FOR VOICE SYNTHESIS

CLAIM FOR PRIORITY

This application claims priority from Japanese Patent Application No. 2000-191573, filed on Jun. 26, 2000, and which is hereby incorporated by reference as if fully set forth herein.

FIELD OF THE INVENTION

The present invention generally relates to voice synthesis for enabling a transaction via a network of voice synthesis data which are obtained by synthesizing the voice of a specific character.

BACKGROUND OF THE INVENTION

Various products such as a toy, an alarm clock and a portable telephone terminal are currently available in which are incorporated the voices of specific characters, such as celebrities, including singers and politicians, or characters appearing on TV shows or in movies. These products are so designed that when a predetermined operation is performed, a message is output using a specific character's voice. This provides an added value for the product.

However, conventionally, data for predetermined phrases using the voice of a specific character are merely stored in a product by the device maker, and the phrasing of messages can not be altered or established by a purchaser (customer) to conform to his or her taste.

According to recent developments in voice synthesis techniques, data can be prepared for the reproduction of voice characteristics, such as voice quality or prosody, unique to the voice of a specific character, so that this data, when applied to a phrase that is input, can be employed to generate a message using a synthesized voice that is very similar to the voice of the specific character.

No particular problem arises when this technique is employed by a device maker, because the procedure by which fees will be assessed and paid for the use of the copyrighted voice of a specific character can be clarified by contract. But if the above technique is provided (sold) as software, for example, to a user (a purchaser), thereby permitting the user to freely generate voice synthesis messages, in this case, the procedure by which fees are to be assessed and paid for copyrighted material belonging to a specific character is unclear.

To resolve this technical problem, it is one objective of the present invention to provide a voice synthesis system for providing voice synthesis messages that are consonant with the tastes of customers, and to provide a voice synthesis method, a server, a storage medium, a program transmission apparatus, a voice synthesis data storage medium and a voice output device.

It is another objective of the present invention to ensure a fee is paid for the use of the copyrighted voice of a specific character, and to protect the rights of that character.

SUMMARY OF THE INVENTION

One aspect of the present invention is a voice synthesis system established between a customer and a service provider via a network comprising: a terminal of the customer used by the customer to select a specific speaker from among speakers who are available for the customer's selection, and to designate text data for which voice synthesis is to be performed; a server of the service provider which employs voice characteristic data for the specific speaker to perform voice synthesis using the text data that is specified by the customer at the terminal to generate voice synthesis data. With this configuration, the customer can order and obtain voice synthesis data, for messages or songs, produced using the voice of a desired speaker, for example, a celebrity such as a singer or a politician, or a character appearing on a TV show or in a movie. Using the obtained voice synthesis data, the user can, in accordance with his or her personal preferences, set up an alarm message for an alarm clock, replace a ringing sound (message) with an answering message for a portable telephone terminal, or to provide guidance, add or alter a guidance message, or messages, for a car navigation system.

The server of a service provider issues a transaction number to a customer, and when the transaction number is transmitted by the terminal of the customer, the server in turn transmits the voice synthesis data to the terminal of the customer. Therefore, voice synthesis data is transmitted only to the customer who has ordered the data. That is, the generated voice synthesis data are data that will never be transmitted to a person other than a customer.

Another aspect of the present invention provides a voice synthesis method employed via a network between a service provider, who maintains voice characteristic data for multiple speakers, and a customer, said method comprising the steps of: the service provider furnishing a list of the multiple speakers via the network to a remote user; the customer transmitting to the service provider, via the network, an identity of a speaker that has been selected from the list, and text data for which voice synthesis is to be performed; and the service provider employing the voice characteristic data for the speaker selected by the customer to perform the voice synthesis using the text data. As a result, the service provider can receive an order for voice synthesis via a network, such as the Internet.

A "remote user" represents a target to which, via a network, a service provider may furnish a list of speakers. Many homepages on the Internet, for example, can be accessed, and data acquired therefrom by a huge, unspecified number of people, who are collectively called "remote users". It should be noted, however, that a person accessing a service provider does not always order voice synthesis data, and that a "remote user" does not always become a "customer".

A service provider assesses a price for the production of data using voice synthesis, and after a customer source has paid the assessed price, transmits the voice synthesis data to the customer. Here, "customer source" represents an individual customer, or a financial organization with which a customer has a contract.

Thereafter, the service provider pays a fee, consonant with the data generated by voice synthesization, to the person whose property, voice characteristic data, was used by the service provider for the voice synthesization process, i.e., a fee is paid to the copyright holder (a specific person or a manager) that is the source of the voice of a specific character, for example, a celebrity such as a singer or a politician, or a character appearing on a TV program or in a movie. Thus, the payment of a fee, or royalty, for the right to use the copyrighted material in question is ensured.

In addition, when the customer inputs to a device the voice synthesis data received from the service provider, a voice can be output based on the ordered voice synthesis data.

The service provider can generate voice synthesis data based on voice characteristic data selected by the customer, and the obtained voice synthesis data can be input to a device selected by the customer. In this manner, the service provider can furnish the desired customer voice synthesis data by loading it into a device.

In another aspect of the present invention is a server, which performs voice synthesis in accordance with a request received from a customer connected across a network, comprising: a voice characteristic data storage unit which stores voice characteristic data obtained by analyzing voices of speakers; a request acceptance unit which accepts, via the network, a request from the customer that includes text data input by the customer and a speaker selected by the customer; and a voice synthesis data generator which, in accordance with the request received from the customer by the request acceptance unit, performs voice synthesis of the text data based on the voice characteristic data of the selected speaker that are stored in the voice characteristic data storage unit.

For each speaker, the voice characteristic data storage unit stores, as voice characteristic data, voice quality data and prosody data.

The server may further comprise: a price setting unit for assessing a price for the voice synthesis data produced based on the request issued by the customer.

The present invention further provides a storage medium, on which a computer readable program is stored, that permits the computer to perform: a process for accepting a request from a remote user to generate voice synthesis data; a process for, in accordance with the request, generating and outputting a transaction number; and a process for, upon the receipt of the transaction number, outputting voice synthesis data that are consonant with the request.

The program further permits the computer to perform: a process for attaching, to the voice synthesis data, verification data that verifies the contents of the voice synthesis data. Therefore, the illegal generation or illegal copying of the voice synthesis data can be prevented. The attached verification data may take any form, such as one for an electronic watermark. In this case, the contents to be verified are, for example, the source of the voice synthesis data or the proof that a legal release was obtained from the copyright holder of the source for the voice.

In another aspect of the present invention comprises a storage device, on which a computer readable program is stored, that permits the computer to perform, a process for accepting, for voice synthesis, a request from a remote user that includes text data and a speaker selected by the remote user; and a process for, in accordance with the request, employing voice characteristic data corresponding to the designated speaker to perform the voice synthesis for the text data.

According to another aspect of the present invention, a program transmission apparatus comprises a storage device which stores a program permitting a computer to perform, a first processor which outputs, to a customer, a list of multiple sets of voice characteristic data stored in the computer; a second processor which outputs, to the customer, voice synthesis data that are obtained by employing voice characteristic data selected from the list by the customer to perform voice synthesis using text data entered by the customer; and a transmitter which reads the program from the storage medium and transmits the program.

The present invention also provides a voice synthesis data storage medium, on which, when a customer connected via a network to a service provider submits a selected speaker and text data to the service provider, and when the service provider generates voice synthesis data in accordance with the selected speaker and the text data submitted by the customer, the voice synthesis data are stored. The voice synthesis data storage medium can be varied, and can be a medium such as a flexible disk, a CD-ROM, a DVD, a memory chip or a hard disk. The voice synthesis data stored on such a voice synthesis data storage medium need only be transmitted to a device such as a computer, a portable telephone terminal or a car navigation system, and the device need only output a voice based on the received voice synthesis data. If a portable memory is employed as a voice synthesis data storage medium, the present invention can be applied when a service provider exchanges voice synthesis data with the customer.

In another aspect of the present invention is a voice output device comprising: a storage unit, which stores voice synthesis data that are generated by a service provider, who retains in storage voice data for multiple speakers, based on a speaker and text data that are submitted via a network to the service provider; and a voice output unit which outputs a voice based on the voice synthesis data stored in the storage unit. This voice output device can be a toy, an alarm clock, a portable telephone terminal, a car navigation system, or a voice replay device, such as a memory player, into all of which the voice synthesis data can be loaded (input).

Furthermore, the present invention provides a program storage device readable by machine, tangibly embodying a program of instructions executable by the machine to perform method steps for voice syntheses, said method comprising the steps of: the service provider furnishing a list of the multiple speakers via the network to a remote user; the customer transmitting to the service provider, via the network, an identity of a speaker that has been selected from the list, and text data for which voice synthesis is to be performed; and the service provider employing the voice characteristic data for the speaker selected by the customer to perform the voice synthesis using the text data.

For a better understanding of the present invention, together with other and further features and advantages thereof, reference is made to the following description, taken in conjunction with the accompanying drawings, and the scope of the invention that will be pointed out in the appended claims.

DETAILED DESCRIPTION OF THE PREFERRED EMBODIMENTS

The present invention will now be described in detail during the course of an explanation of the preferred embodiment given while referring to the accompanying drawings.

Figure 1:
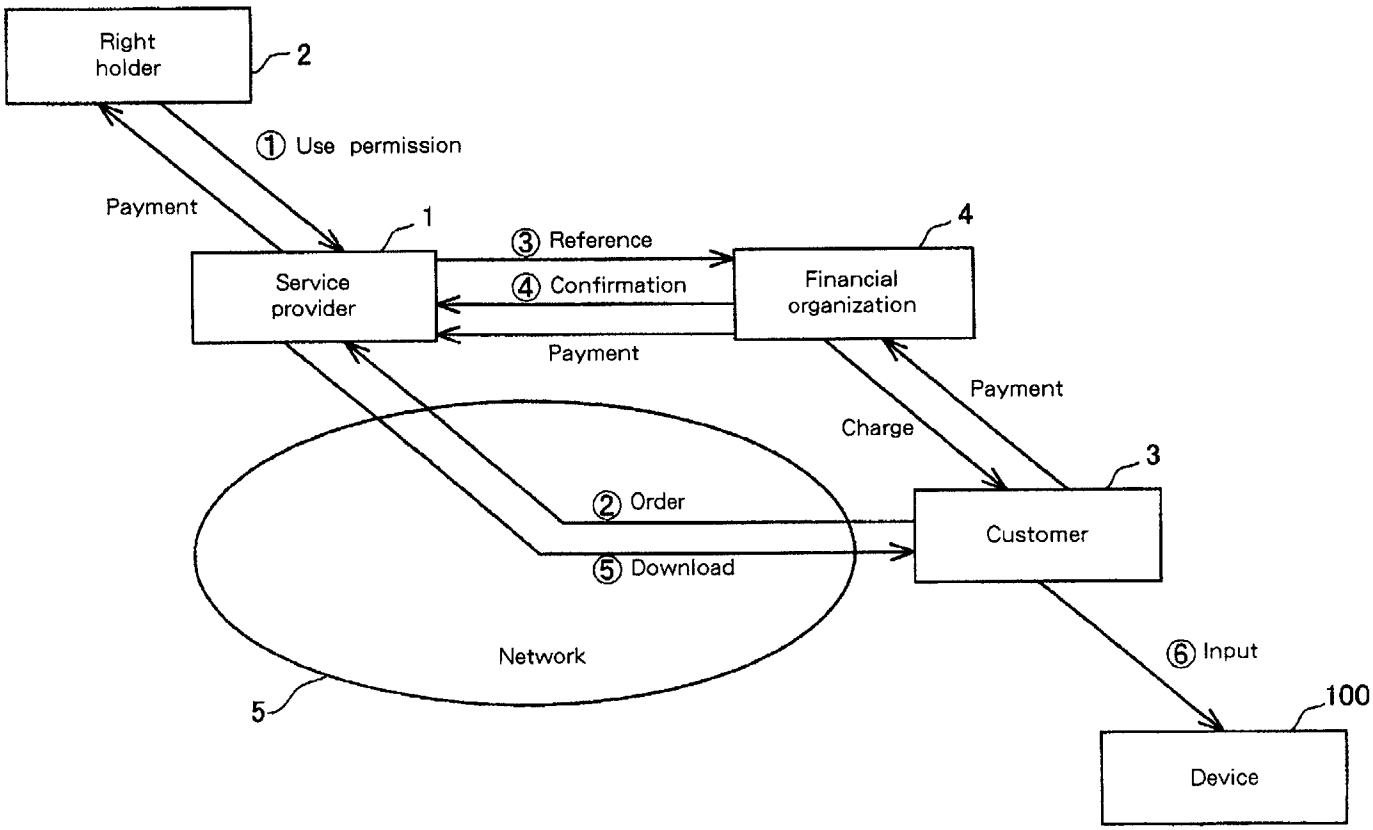
FIG. 1 is a diagram illustrating a system configuration according to one embodiment of the present invention.

FIG. 1 is a diagram for explaining a system configuration in accordance with the embodiment. A service provider 1, which provides voice synthesis data, serves as a web server for the system in accordance with the embodiment, and a right holder 2, who owns or manages a right (a copyright, etc.), controls the employment of a voice, the source of which is, for example, a celebrity such as a singer or a politician or a character appearing on a TV program or in a movie. The service provider 1 and the right holder 2 have previously entered into a contact, covering permission to employ voice data and conditions under which royalty payments will be made when such voice data are employed. A customer 3 (a remote user or a customer source) is a purchaser who desires to buy voice-synthesized data. A financial organization 4 (customer source) has negotiated a tie-in with the service provider 1, and is, for example, a credit card company or a bank that provides an immediate settlement service, such as is provided by a debit card. A network 5, such as the Internet, is connected to the service provider 1, which is a web server, and the customer 3, which is a web terminal.

The web terminal of the customer 3 is, for example, a PC at which software, such as a web browser, is available, and can browse the homepage of the service provider 1 and use the screen of a display unit to visually present items of information that are received. Further, the web terminal includes input means, such as a pointing device or a keyboard, for entering a variety of data or money values on the screen.

The financial organization 4 is connected to the service provider 1 via a network 5, or another network, to facilitate the exchange of information with the service provider 1. The financial organization 4 and the customer 3 have also previously entered into a contract.

In this embodiment, upon the receipt of an order from the customer 3, the service provider 1 furnishes voice synthesis data for the output (the release) of text, submitted by the customer 3, using the voice of a specific character (hereinafter referred to as a speaker) that was designated by the customer 3.

Figure 2:
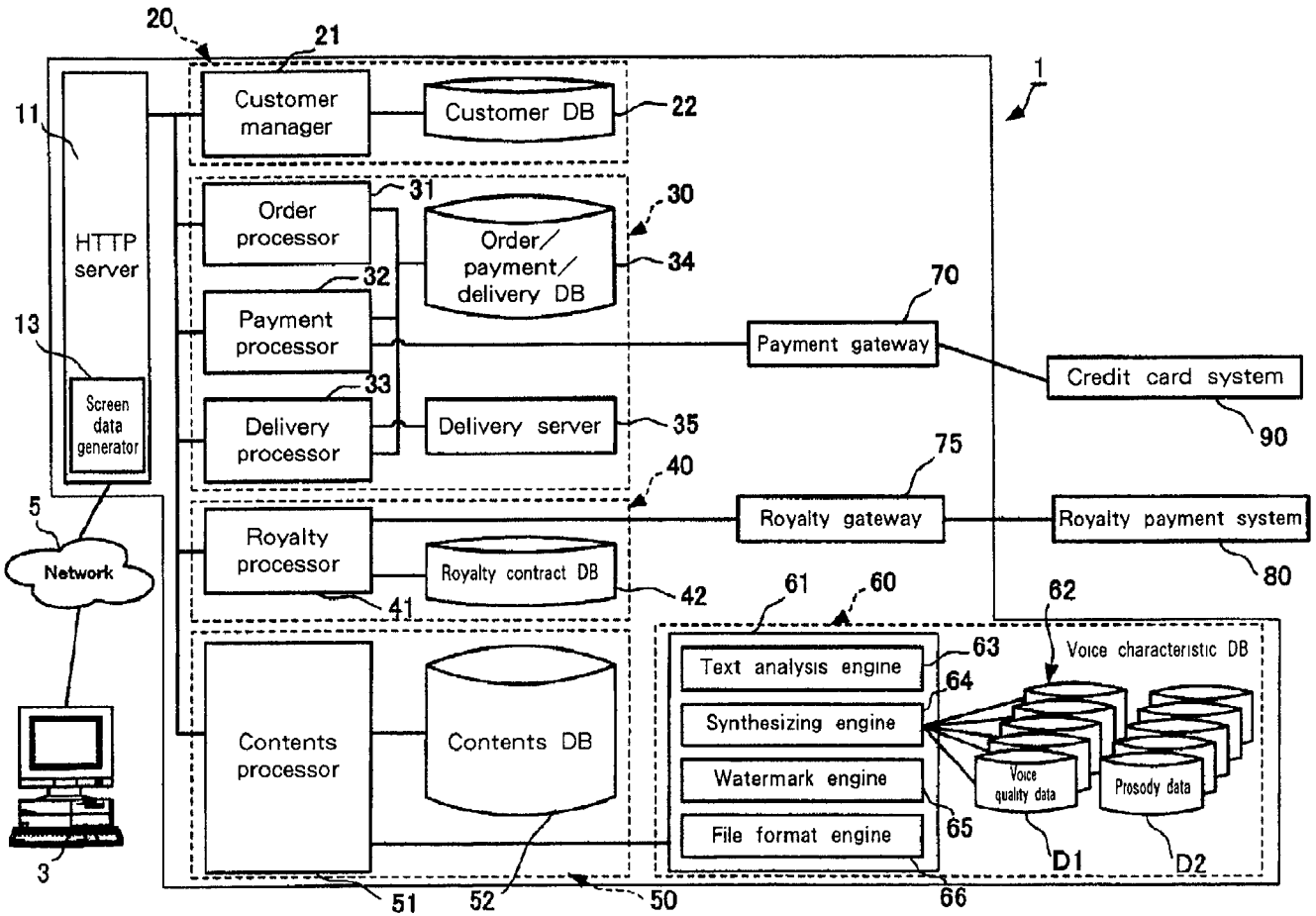
FIG. 2 is a diagram illustrating the server arrangement of a service provider.

FIG. 2 is a block diagram illustrating the server configuration of the service provider 1, which is a web server. In FIG. 2, an HTTP server 11, which is used as a transmission/reception unit for the network 5, exchanges data, via the network 5, with an external web terminal. This HTTP server 11 roughly comprises: a customer management block 20, for performing a process related to customer information; an order/payment/delivery block 30, for handling orders and payments received from the customer 3, and for effecting deliveries to the customer 3; a royalty processing block 40, for performing a process based on a contract covering royalty payments to the right holder 2; a contents processing block 50, for performing a process to generate voice synthesis data; and a voice synthesis data generation block 60, for generating voice synthesis data upon the receipt of an order from the customer 3. To transfer money for charge and royalty payments related to a process performed for the customer 3, the HTTP server 11 further comprises a payment gateway 70 and a royalty gateway 75. The HTTP server 11 is connected via the payment gateway 70 and the royalty gateway 75 to a royalty payment system 80 and a credit card system 90, which are provided outside the server by the service provider 1.

The HTTP server 11 also includes a screen data generator 13, which receives data entered by the customer 3 and which distributes the data to the individual sections of the server 11 in accordance with the type. Further, the screen data generator 13 can generate screen data based on data received from the individual sections of the server 11.

The customer management block 20 includes a customer management unit 21 and a customer database (DB) 22. The customer management unit 21 stores, in the customer DB 22, information obtained from the customer 3, such as the name, the address and the e-mail address of the customer 3, and as needed, extracts the stored information from the customer DB 22.

The order/payment/delivery block 30 includes an order processor (request receiver) 31, a payment processor (price setting unit) 32, a delivery processor 33, an order/payment/delivery DB 34, and a delivery server 35.

The order processor 31 stores the contents of an order submitted by the customer 3 in the order/payment/delivery DB 34, and issues an instruction to the contents processing block 50 to generate voice synthesis data based on the order.

The payment processor 32 calculates an appropriate price for the order received from the customer 3, using price data that is stored in advance in the order/payment/delivery DB 34, and outputs the price. Further, the payment processor 32 stores, in the order/payment/delivery DB 34, information related to the payment, such as credit card information obtained from the customer 3. In addition, through the payment gateway 70 and the credit card system 90, which are separate from the server 11, the payment processor 32 requests from the financial organization 4 verification of the credit card information furnished by the customer 3, transmits the assessed price to the financial organization 4, and confirms that payment has been received from the financial organization 4.

The delivery processor 33 manages and outputs a schedule for processes to be performed up until the voice synthesis data, generated upon the receipt of the order from the customer 3, is ready for delivery, outputs the URLs (Uniform Resource Locators) required for the customer 3 to receive the voice synthesis data, and generates and outputs a transaction ID for the order received from the customer 3. The information output by the delivery processor 33 to the customer 3 is stored, as needed, in the order/payment/deliver DB 34.

The royalty processing block 40 includes a royalty processor 41 and a royalty contract DB 42. Data for the royalty contract entered into with the right holder 2 are stored in the royalty contract DB 42, and based on these data, the royalty processor 41 calculates a royalty payment consonant with the order received from the customer 3, and via the royalty gateway 75 and the royalty payment system 80, pays the royalty to the right holder 2.

The contents process block 50 includes a contents processor (voice synthesis data generator) 51 and a contents DB 52. The contents processor 51 stores, in the contents DB 52, the information concerning the contents of the order received from the order processor 31 and the designated speaker and the text, and outputs the voice synthesis data that are generated by the voice synthesis data generation block 60, which will be described later.

Further, a list of registered speakers (voices) and voice sample data for part or all of those speakers are stored in the contents DB 52, and in accordance with the request received from the customer 3, the contents processor 51 outputs designated voice sample data.

The voice synthesis data generation block 60 includes a voice synthesizer (voice synthesis data generator) 61 and a voice characteristic DB (voice characteristic data storage unit) 62.

The voice data (voice characteristic data), which are registered in advance, for speakers are stored in the voice characteristic DB 62. The voice data consists of voice quality data D1, which are used for the quality of the voice of each registered speaker, and prosody data D2, which are used for the prosody of a pertinent speaker. The voice quality data D1 and the prosody data D2 for each speaker are stored in the voice characteristic DB 62.

Figure 3:
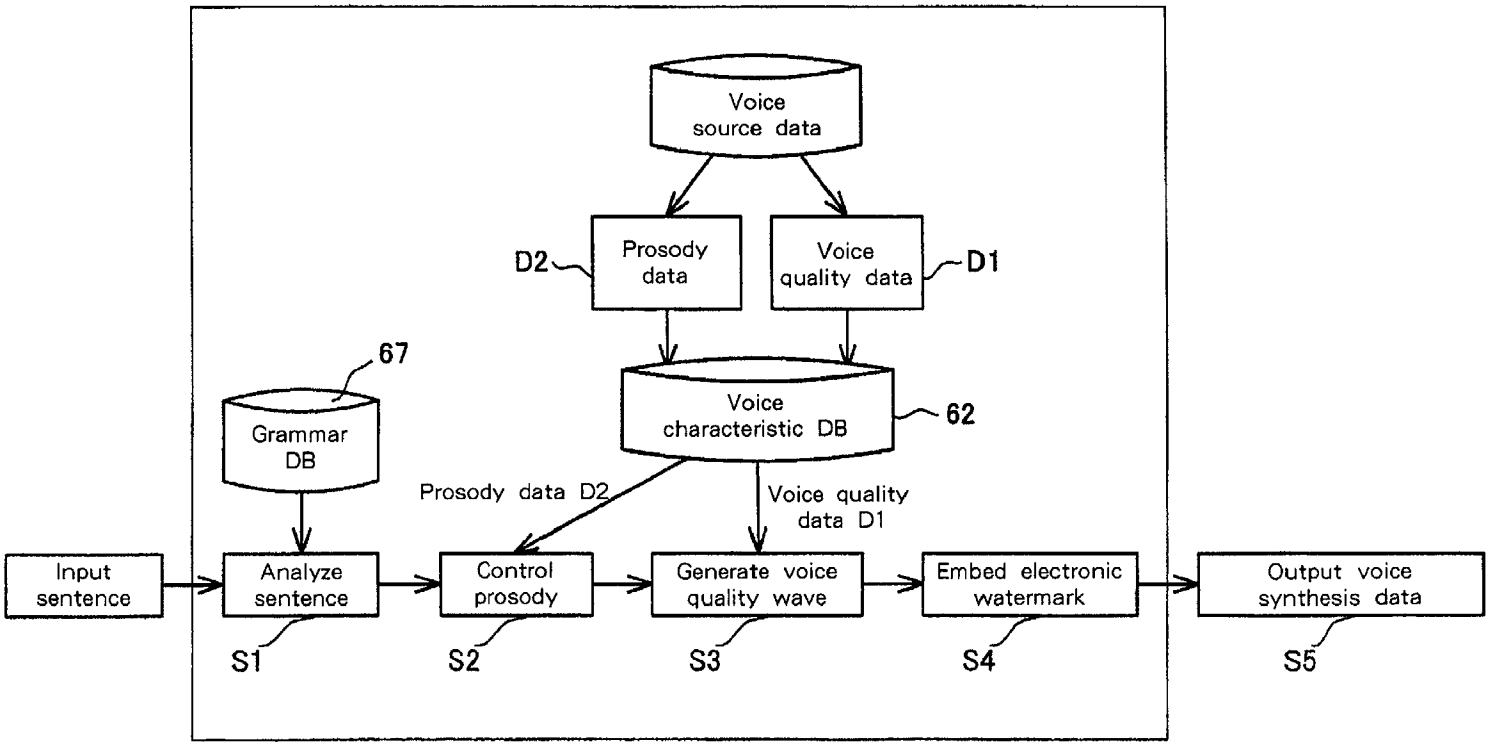
FIG. 3 is a diagram showing a voice synthesis data generation method used by the service provider.

As is shown in FIG. 3, to obtain the voice data stored in the voice characteristic DB 62, first, the voice of an individual voice is recorded directly, while the individual is speaking or singing, or from a TV program or a movie, and from the recording, voice source data is extracted and stored. Subsequently, the voice source data are analyzed to extract the voice characteristics of the speaker, i.e., the voice quality and the prosody, and the extracted voice quality and prosody are used to prepare the voice quality data D1 and the prosody data D2.

As is shown in FIG. 2, the voice synthesizer 61 includes a text analysis engine 63, for analyzing a sentence; a synthesizing engine 64, for generating voice synthesis data; a watermark engine 65, for embedding an electronic watermark in voice synthesis data; and a file format engine 66, for changing the voice synthesis data to prepare a file.

To generate voice synthesis data, first, the voice synthesizer 61 extracts, from the contents DB 52, data indicating a speaker designated in the order received from the customer 3, extracts the voice data (the voice quality data D1 and the prosody data D2) for this speaker from the voice characteristic DB 62, and extracts, from the contents DB 52, a sentence designated by the customer 3.

As is shown in FIG. 3, the sentence input by the customer 3 is analyzed in accordance with the grammar that is stored in a grammar DB 67 in the text analysis engine 63 (step S1). Then, the synthesizing engine 64 employs the analyzation results and the prosody data D2 to control the prosody in consonance with the input sentence (step S2), so that the prosody of the speaker is reflected. Following this, a voice wave is generated by combining the voice quality data D1 of the speaker with the data reflecting the prosody of the speaker, and is employed to obtain predetermined voice synthesis data (step S3). The predetermined voice synthesis data is voice data that enables the designated sentence to be output (released) with the voice of the speaker designated in the order received from the customer 3.

The watermark engine 65 embeds an electronic watermark (verification data) in the voice synthesis data to verify that the voice synthesis data have been authenticated, i.e., that the permission has been obtained from the holder of the voice source right (step S4).

Thereafter, the file format engine 66 converts the voice synthesis data into a predetermined file format, e.g., a WAV sound file, and provides a file name indicating that the voice synthesis data have been prepared for the text entered by the customer 3.

The thus generated voice synthesis data are then output by the voice synthesizer 61 (step S5), and are stored in the contents DB 52 until they are downloaded by the customer 3. At this time, in the contents DB 52, the voice synthesis data are stored with a correlating transaction ID provided when the order was issued by the customer 3.

Since various techniques have been proposed, or are now in practical use, for the actual extraction from voices of voice quality data D1 and prosody data d2 that can be used for the generation of voice synthesis data, and since for the purposes of this invention all that is necessary is for certain of these techniques to be employed appropriately, this embodiment is not limited to a specific technique. One example technique is the one disclosed in Japanese Unexamined Patent Publication No. Hei 9-90970. With this technique, the voice of a specific speaker can be synthesized in the above-described manner. However, the technique disclosed in this publication is merely an example, and other techniques can be employed.

An explanation will now be given, while referring to FIGS. 4 to 6, for a method whereby a customer 3 purchases desired voice synthesis data from a system such as is described above.

Figure 4:
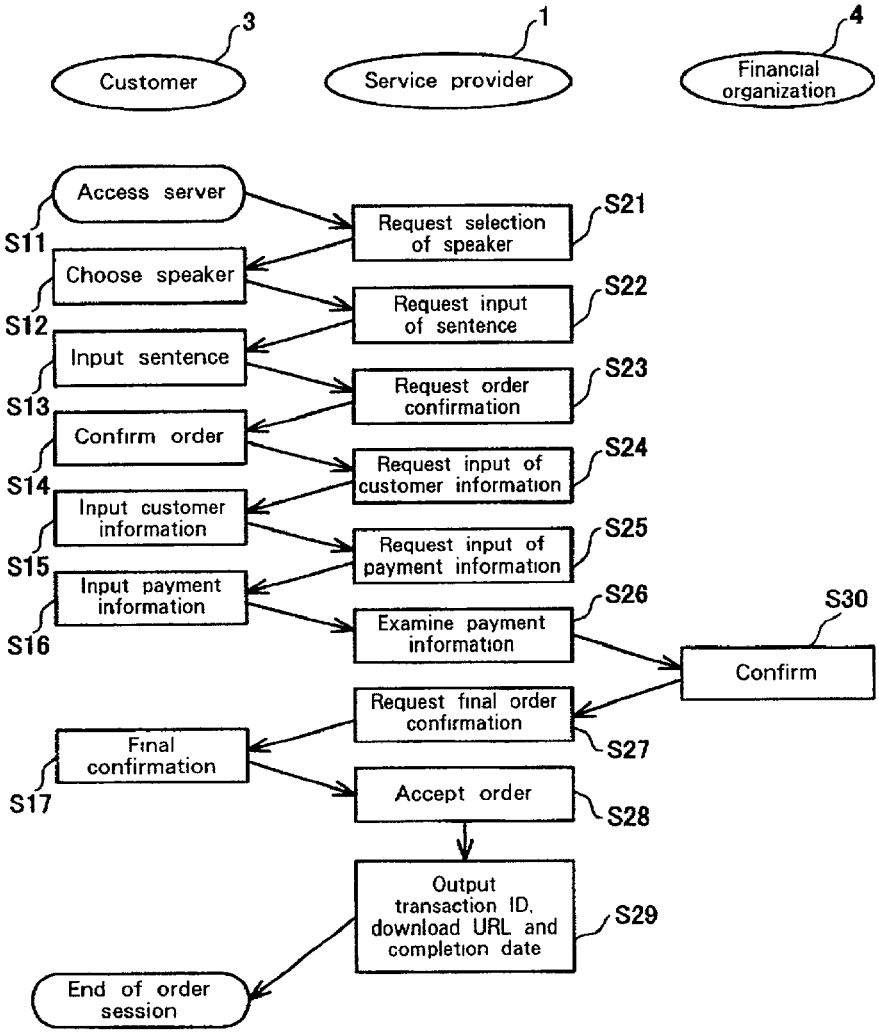
FIG. 4 is a flowchart showing the processing performed when a customer issues an order for voice synthesis data.

FIG. 4 is a flowchart showing a business transaction conducted by the service provider 1 and the customer 3. As is shown in FIG. 4, first, the customer 3 accesses the web server of the service provider 1 via the network 5, which includes the Internet (step S11). Then, the order processor 31 of the service provider 1 issues a speaker selection request to the customer 3 (step S21). At this time, the list of speakers registered in the contents DB 52 of the service provider 1 is displayed on the screen of the web terminal of the customer 3. In this list, the names of speakers are specifically displayed, in accordance with genres, in alphabetical order or in an order corresponding to that of the Japanese syllabary, and along with the names, portraits of the speakers or animated sequences may be displayed. Thereafter, the customer 3 chooses a desired speaker (a specific voice source) from the list, and enters the speaker that was chosen by manipulating a button on the display (step S12). During the speaker selection process, the customer 3, as an aid in determining which speaker to choose, can also download, as desired, voice sample data stored in the DB 52 that can be used to reproduce the voices of selected speakers.

After the speaker has been chosen, the order processor 31 of the service provider 1 issues a sentence input request to the customer 3 (step S22). The customer 3 then employs input means, such as a keyboard, to enter a desired sentence in the input column displayed on the screen (step S13).

In the order processor 31 of the service provider 1, the text analysis engine 63 analyzes the input sentence to perform a legal check, and counts the number of characters or the number of words that constitute the sentence. Further, the royalty contract DB 42 is referred to, and a base price, which includes the royalty that is to be paid to the speaker chosen at step S12, is obtained. Then, the payment processor 32 employs the character count or word count and the base price consonant with the chosen speaker to calculate a price that corresponds to the contents of the order submitted by the customer 3.

Thereafter, the order processor 31 displays the contents of the order received from the customer 3, i.e., the name of the chosen speaker and the input sentence, and the price consonant with the contents of the order, and requests that the customer 3 confirm the contents of the order (step S23). To confirm the order contents displayed by the service provider 1, the customer 3 depresses a button on the display (step S14).

Next, the order processor 31 of the service provider 1 requests that the customer 3 enter customer information (step S24). The customer 3 then inputs his or her name, address and e-mail address, as needed (step S15). At the service provider 1, the customer management unit 21 stores the information obtained from the customer 3 in the customer DB 22.

Since the order processor 31 of the service provider 1 requested that the customer 3 sequentially enter payment information (step S25), the customer 3 then enters his or her credit card type and credit card number (step S16). At this time, if an immediate settlement system, such as one for which a debit card is used, is available, the number of the bank cash card and the PIN number may be entered as payment information.

At step S15 or S16, if the customer 3 is registered in advance in the service provider 1, at step S11 for the access (log-in) or at step S16, the member ID or the password of the customer 3 can be input, and the input of the customer information at step S15 and the input of the payment information at step S16 can be eliminated.

When the service provider 1 receives the payment information from the customer 3, the payment processor 32 issues an inquiry to the financial organization 4 via the payment gateway 70 and the credit card system 90 to refer to the payment information for the customer 3 (step S26). Upon the receipt of the inquiry, the financial organization 4 examines the payment information for the customer 3, and returns the results of the examination (approval or disapproval) to the service provider 1 (step S30). Then, when the payment processor 32 receives an approval from the financial organization 4, the payment processor 32 stores the payment information for the customer 3 in the order/payment/delivery DB 34.

The order processor 31 of the service provider 1 then requests that the customer 3 enter a final conformation of the order (step S27), and the customer 3, before entering the final confirmation, checks the order (step S17).

Upon the receipt of the final confirmation entered by the customer 3, the order processor 31 of the service provider 1 accepts the order (step S28), and transmits the contents of the order to the contents processor 51. At the same time, the delivery processor 33, which provides an individual transaction number (transaction ID) for each order received, generates a transaction ID for the pertinent order received from the customer 3. The order processor 31 thereafter outputs, with the transaction ID generated by the delivery processor 33, the URL of a site at which the customer 3 can later download the voice synthesis data and a schedule (data completion planned date) for the processes to be performed before the voice synthesis data can be obtained and delivered (step S29). Furthermore, the HTTP server 11 transmits, to the customer 3, the method to be used for downloading the generated voice synthesis data. When the customer 3 has received this information, the order session is thereafter terminated.

As is described above, the service provider 1 that receives the order from the customer 3 employs the contents of the order to generate, in the above-described manner, the voice synthesis data. The service provider 1 also issues to the financial organization 4 a request for the settlement of a fee that is consonant with the order submitted by the customer 3. So long as the order from the customer 3 has been received, this request may be issued before, during or after the voice synthesis data are generated, or it can be issued after the voice synthesis data have been delivered to the customer 3. An example process is shown in FIG. 5.

Figure 5:
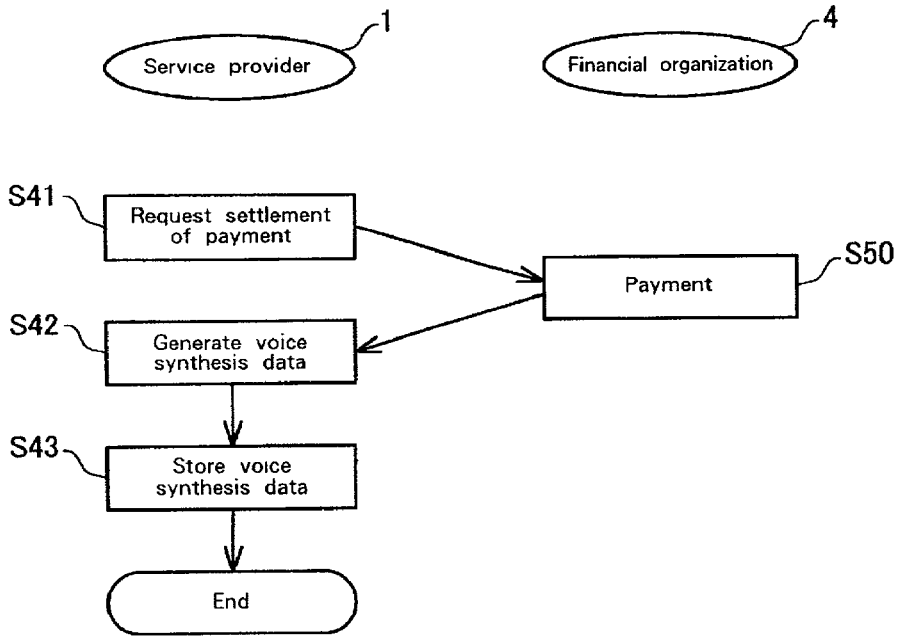
FIG. 5 is a flowchart showing the processing performed to generate voice synthesis data.

As is shown in FIG. 5, in the service provider 1, after the order session with the customer 3 has been terminated, the payment processor 32 issues a request to the financial organization 4, via the payment gateway 70 and the credit card system 90, for the settlement of a charge that is consonant with the order received from the customer 3 (step S41). Upon the receipt of this request, the financial organization 4 remits the amount of the charge issued by the service provider 1 (step S50). When the service provider 1 confirms that payment has been made by the financial organization 4, the preparation of the voice synthesis data is begun (step S42). Then, after the voice synthesis data have been generated, the data are stored in the contents DB 52 (step S43).

Figure 6:
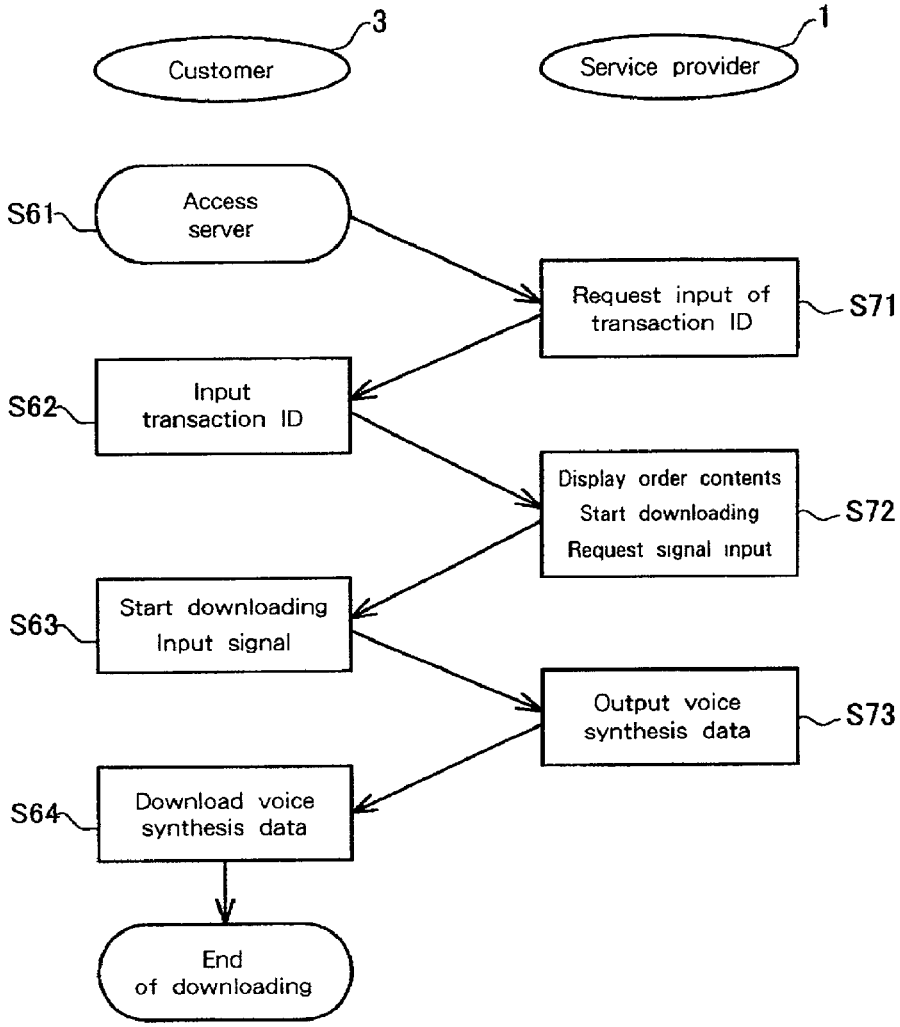
FIG. 6 is a flowchart showing the processing performed when ordered voice synthesis data are delivered to the customer.

The processing in FIG. 6 is performed up until the customer 3 receives the ordered voice synthesis data, on or after the planned data completion date, which the service provider 1 transmitted to the customer 3 at step S29 in the order session.

As is shown in FIG. 6, the customer 3 accesses the URL of the server of the service provider 1 that is transmitted at step S29 in the order session (step S61). Then, the contents processor 51 of the service provider 1 requests that the customer 3 enter the transaction ID (step S71). The customer 3 thereafter inputs the transaction ID that was designated by the service provider 1 at step S29 in the order session (step S62). Since the transaction ID is used as a so-called duplicate key when downloading the ordered voice synthesis data, the voice synthesis data cannot be obtained unless a matching transaction ID is entered.

When the transaction ID entered by the customer 3 matches the transaction ID stored in the order/payment/delivery DB 34, the delivery processor 33 displays, for the customer 3, the contents of the order for the customer 3 that are stored in the order/payment/delivery DB 34. The contents of the order to be displayed include the name of the customer 3, the name of the chosen speaker and the sentence for which the processing was ordered. The delivery processor 33 also displays on the screen of the customer 3 the buttons to be used to download the file containing the voice synthesis data that was ordered, and requests that the customer 3 input a download start signal (step S72).

When the customer 3 manipulates the button on the display, the signal to start the downloading of the file containing the voice synthesis data is transmitted to the service provider 1 (step S63).

When the service provider 1 receives this signal, the contents processor 51 outputs, to the customer 3, the file containing the voice synthesis data that were generated in accordance with the order submitted by the customer 3 and that is stored in the predetermined file format in the contents DB 52 (step S73), while the customer 3 downloads the file (step S64). When the downloading is completed, the downloading session for the voice synthesis data is terminated, i.e., the transaction with the service provider 1 relative to the order submitted by the customer 3 is completed.

Separate from the order session, the financial organization 4 requests that the customer 3 remit the payment for the charge, and the customer 3 pays the charge to the financial organization 4.

Also, the service provider 1 independently remits to the right holder 2 a royalty payment that is consonant with the contents of the order submitted by the customer 3.

The customer 3 may store the downloaded file of the voice synthesis data in the PC terminal, and may replay the data using dedicated software. Further, when the customer 3 purchases, or already owns, the voice output device 100, as is shown in FIG. 1, that has a storage unit for storing voice synthesis data and a voice output unit for outputting a voice based on the voice synthesis data stored in the storage unit, e.g., a toy, an alarm clock, a portable telephone terminal, a car navigation system or a voice data replaying device, such as a so-called memory player, the customer 3 may load the downloaded voice synthesis data into the device 100, and may use the device 100 to replay the voice synthesis data. At this time, a connection cable for data transmission may be employed, or radio or infrared communication may be performed to load the voice synthesis data into the device 100. Further, the voice synthesis data may be stored in a portable memory (voice synthesis data storage medium), and may be thereafter be transferred to the device 100 via the memory.

In FIG. 1, the processing is shown that is performed from the time the order for the above described voice synthesis data was received until the data were delivered. In FIG. 1, (1) to (6) indicate the order in which the important processes were performed up until the voice synthesis data were provided.

In the above described manner, the customer 3 can employ the ordered voice synthesis data to output a sentence using the voice of a desired speaker, such as a celebrity, including a singer and a politician, or a character on a TV program or in a movie, through his or her PC or device 100. In other words, an alarm (a message) for an alarm clock, an answering message for a portable telephone terminal, or a guidance message for a car navigation system, for example, can be altered as desired by the customer 3.

Since voice synthesis data is generated in accordance with an order submitted by the customer 3, and is transmitted to the customer 3 in consonance with a transaction ID, the voice synthesis data is uniquely produced for each customer 3. Further, at this time, the price is set in consonance with the order received from the customer 3, and the royalty payment to the voice source right holder 2 is ensured.

Furthermore, with the above system, the customer 3 can, at his or her discretion, change the message to be replayed by the device 100 into which the voice synthesis data was loaded. That is, when the customer 3 issues an order and obtains new voice synthesis data, he or she can replace the old voice synthesis data stored in the device 100 with the new voice synthesis data. In this manner, the above system can prevent the customer 3 from becoming bored with the device 100, and can add to the value of the device 100.

In the above embodiment, the delivery processor 33 notifies the customer 3 of the planned data completion date, and the customer 3 receives the voice synthesis data on or after the planned data completion date. However, if the voice synthesis data can be provided for the customer 3 during the session begun after the order was received from the customer (e.g., immediately after the order was accepted), the above process is not required.

When a predetermined data entry or confirmation is not performed during the processing in FIGS. 4 to 6, the processing will naturally be halted, or the process will return to the previous step.

Another embodiment will now be described while referring to FIG. 7. In the following explanation, the same reference numerals are employed to denote corresponding components as are used in the above embodiment, and no further explanation for them will be given.

Figure 7:
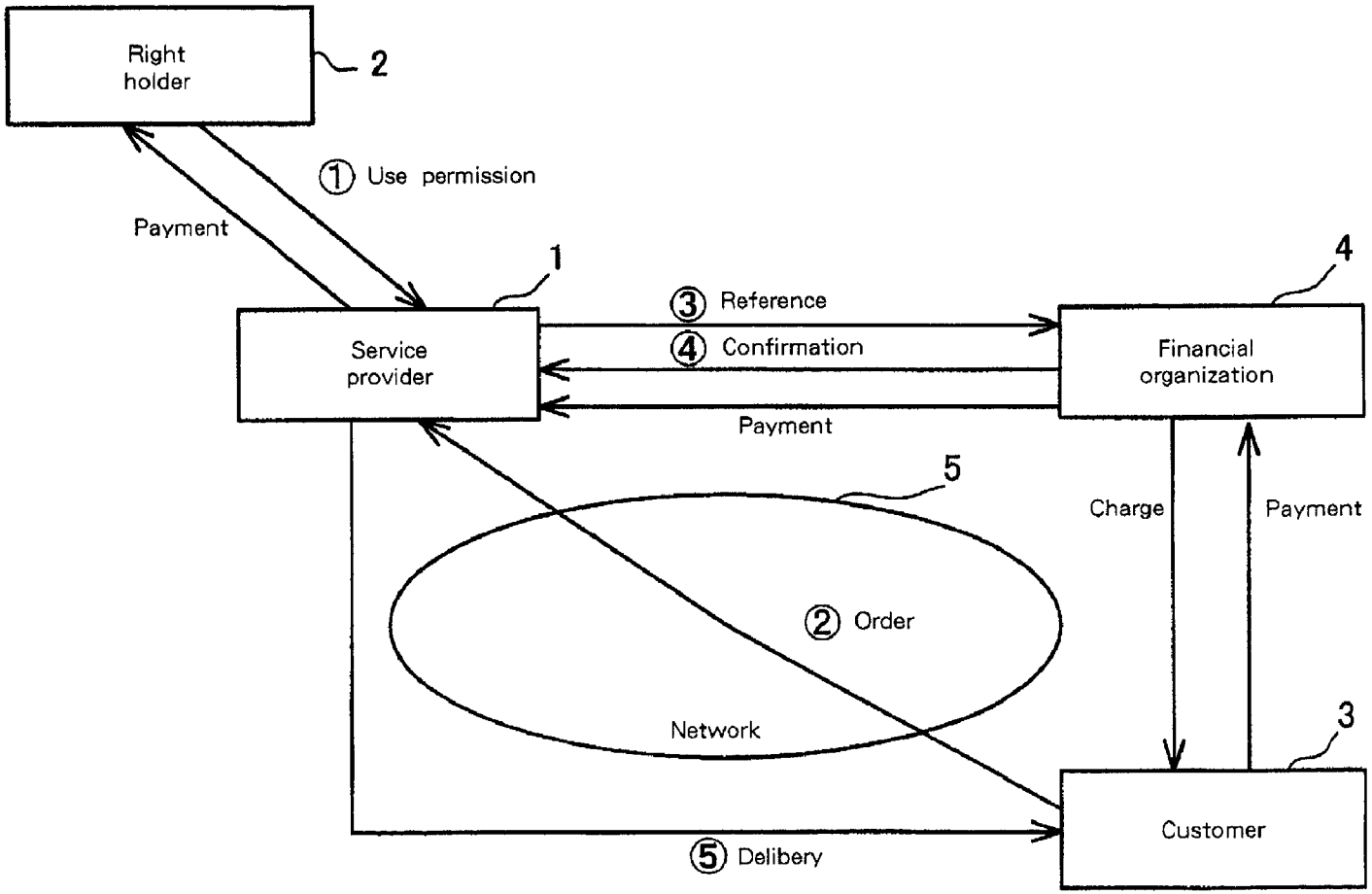
FIG. 7 is a diagram illustrating the system configuration for another embodiment.

In the embodiment in FIG. 7, the service provider 1 provides, for the customer 3, not only the voice synthesis data but also a device into which the ordered voice synthesis data are loaded. FIG. 7 shows the processing performed beginning with the receipt from a customer of an order for the above described voice synthesis data up until the data are received, and (1) to (5) represent the order in which the important processes are performed up until the voice synthesis data are delivered.

The service provider 1 furnishes the customer 3 the list of speakers and the list of devices. The customer 3 may order any device into which he or she can load input voice synthesis data, such as a toy, an alarm clock or a car navigation system.

The customer 3 issues an order for the voice synthesis data to the service provider 1 in the same manner as in the previous embodiment, and also issues an order for a device into which voice synthesis data are to be loaded. The order for the device need only be issued at an appropriate time during the order session (see FIG. 4) in the previous embodiment. The service provider 1 will then present, to the customer 3, a price that is consonant with the costs of the voice synthesis data and the selected device that were ordered. When the customer 3 confirms the contents of the order and notifies the service provider 1, the issuing of the order is completed.

In accordance with the order submitted by the customer 3, the service provider 1 generates voice synthesis data in the same manner as in the above embodiment, loads the voice synthesis data into the device selected by the customer 3, and delivers this device to the customer 3. Furthermore, to settle the charge for the voice synthesis data and the device ordered by the customer 3, the service provider 1 requests that payment of the charge be made by the financial organization 4 designated by the customer 3.

In addition, the customer 3 pays the financial organization 4 the price consonant with the order, and the service provider 1 remits to the right holder 2 a royalty payment consonant with the voice synthesis data that were generated. All the transactions are thereafter terminated.

In the above embodiments, the times for the settlement of the charges between the service provider 1 and the financial organization 4 and between the financial organization 4 and the customer 3 are not limited as is described above, and any arbitrary time can be employed. Further, the payment by the customer 3 to the service provider 1 need not always be performed via the financial organization 4, and electronic money or a prepaid card may be employed.

As is described in the above embodiments, the customer 3 may purchase only the voice synthesis data, or the device 100 in which the voice synthesis data is loaded. In addition, the customer 3 may transmit the voice synthesis data that he or she purchased to a device maker, and the device maker may load the voice synthesis data into a device, as requested by the customer 3, and then sell the device to the customer 3. Or, the service provider 1 may transmit, to a device maker, voice synthesis data generated in accordance with an order submitted by the customer 3, and the device maker may load the voice synthesis data into a device that it thereafter delivers to the customer 3.

The voice synthesis data is not limited to a simple voice message, but may be a song (with or without accompaniment) or a reading. Further, the customer 3 can also freely arrange the contents of a sentence, and may, for example, select a sentence from a list of sentences furnished by the service provider 1. With this arrangement, when the service provider 1 furnishes, for example, a poem or a novel as a sentence, and the customer 3 selects a speaker, the customer 3 can obtain the voice synthesis data for a reading performed by a favorite speaker.

As is described in the embodiments, the voice synthesis data can be provided for the customer 3, by the service provider 1, not only by using online transmission (downloading) or by using a device into which the data are loaded, but also by storing the data on various forms of storage media (voice synthesis data storage media), such as a flexible disk.

In addition, in order to permit a computer to execute the above program, the present invention may be provided as a program storage medium, such as a CD-ROM, a DVD, a memory chip or a hard disk. Further, the present invention may be provided as a program transmission apparatus that comprises: a storage device, such as a CD-ROM, a DVD, a memory chip or a hard disk, on which the above program is stored; and a transmitter for reading the program from the storage medium and for transmitting the program directly or indirectly to an apparatus that executes the program.

As is described above, according to the present invention, the customer can obtain voice synthesis data for a desired sentence executed using the voice of a desired speaker, and the payment of royalties to the voice source right holder is ensured.

If not otherwise stated herein, it is to be assumed that all patents, patent applications, patent publications and other publications (including web-based publications) mentioned and cited herein are hereby fully incorporated by reference herein as if set forth in their entirety herein.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention

What is claimed is:

1. A voice synthesis system established between a customer and a service provider who maintains voice characteristic data for multiple speakers, via a network comprising:

a terminal of the customer used by the customer to select a specific speaker from among a list of speakers who are available for the customers selection, wherein the service provider furnishes the list of the speakers via the network, and said terminal used to designate text data for which voice synthesis is to be performed; and a server of the service provider which employs voice characteristic data for the specific speaker to perform voice synthesis using the text data that is specified by the customer at the terminal to generate voice synthesis data, whereby the service provider furnishes the customer, together with the list of the speakers, a list of devices into which voice synthesis data can be loaded; whereby the customer notifies the service provider, via the network, which device was selected from the list; and whereby the service provider generates voice synthesis data based on the voice characteristic data of the sneaker selected by the customer and loads the obtained voice synthesis data into the device selected by the customer.

2. The voice synthesis system according to claim 1, wherein the server of the service provider assigns a transaction number to the customer; and wherein, when the transaction number is presented by the terminal of the customer, the server transmits the voice synthesis data to the terminal of the customer.

3. A voice synthesis method employed via a network between a service provider, who maintains voice characteristic data for multiple speakers, and a customer, said method comprising the steps of:

the service provider furnishing a list of the multiple speakers via the network to a remote user;

the customer transmitting to the service provider, via the network, an identity of a speaker that has been selected from the list, and text data for which voice synthesis is to be performed; and the service provider employing the voice characteristic data for the speaker selected by the customer to perform the voice synthesis using the text data, whereby the service provider furnishes the customer, together with the list of the speakers, a list of devices into which the voice synthesis data can be loaded; whereby the customer notifies the service provider, via the network, which device was selected from the list; and whereby the service provider generates voice synthesis data based on the voice characteristic data of the speaker selected by the customer and loads the obtained voice synthesis data into the device selected by the customer.

4. The voice synthesis method according to claim 3, whereby the service provider assesses a charge for voice synthesis data produced using the voice synthesis, and transmits the voice synthesis data to the customer upon receipt from the customer of payment for the charge.

5. The voice synthesis method according to claim 3, whereby the service provider pays a fee that is consonant with the generation of the voice synthesis data to a person who owns all rights to the voice characteristic data that the service provider holds.

6. A server, which performs voice synthesis in accordance with a request received from a customer connected across a network, comprising:

a voice characteristic data storage unit which stores voice characteristic data obtained by analyzing voices of speakers;

a request acceptance unit which accepts, via the network, a request from the customer that includes text data input by the customer and a speaker selected by the customer from a list of multiple speakers provided by a service provider via a network; and a voice synthesis data generator which, in accordance with the request received from the customer by the request acceptance unit, performs voice synthesis of the text data based on the voice characteristic data of the selected speaker that are stored in the voice characteristic data storage unit, whereby the service provider furnishes the customer, together with the list of the speakers, a list of devices into which voice synthesis data can be loaded; whereby the customer notifies the service provider, via the network, which device was selected from the list; and whereby the service provider generates voice synthesis data based on the voice characteristic data of the sneaker selected by the customer and loads the obtained voice synthesis data into the device selected by the customer.

7. The server according to claim 6, wherein the voice characteristic data storage unit stores for each speaker, as the voice characteristic data, voice quality data and prosody data.

8. The server according to claim 6, further comprising a price setting unit which sets a price for the voice synthesis data based on the request issued by the customer.

9. A storage device, on which a computer readable program is stored, that permits the computer to perform:

a process for accepting a request from a remote user to generate voice synthesis data for a speaker selected by the remote user from a list of multiple speakers provided by a service provider via a network, wherein the remote user transmitting to the service provider, via the network, an identity of a speaker that has been selected from the list, and text data for which voice synthesis is to be performed, and wherein the service provider employing the voice characteristic data for the speaker selected by the remote user to nerform the voice synthesis using the text data;

a process for, in accordance with the request, generating and outputting a transaction number; and a process for, upon the receipt of the transaction number, outputting voice synthesis data that are consonant with the request, whereby the service provider furnishes the remote user, together with the list of the speakers, a list of devices into which the voice synthesis data can be loaded; whereby the remote user notifies the service provider, via the network, which device was selected from the list; and whereby the service provider generates voice synthesis data based on the voice characteristic data of the speaker selected by the remote user and loads the obtained voice synthesis data into the device selected by the remote user.

10. The program storage device according to claim 9, wherein the program permits the computer to further perform a process which attaches, to the voice synthesis data, verification data for verifying the contents of the voice synthesis data.

11. A storage medium, on which a computer readable program is stored, that permits the computer to perform:

a process, for accepting, for voice synthesis, a request from a remote user that includes text data and a speaker selected by the remote user, from a list of multiple speakers provided by service provider via a network, wherein the remote user transmitting to the service provider, via the network, an identity of a speaker that has been selected from the list, and text data for which voice synthesis is to be performed, and wherein the service provider employing the voice characteristic data for the speaker selected by the remote user to perform the voice synthesis using the text data; and a process for, in accordance with the request, employing voice characteristic data corresponding to the designated speaker to perform the voice synthesis for the text data; and whereby the service provider furnishes the remote user, together with the list of the speakers, a list of devices into which voice synthesis data can be loaded; whereby the remote user notifies the service provider, via the network, which device was selected from the list; and whereby the service provider generates voice synthesis data based on the voice characteristic data of the speaker selected by the remote user and loads the obtained voice synthesis data into the device selected by the remote user.

12. A program transmission apparatus comprising:

a storage device which stores a program permitting a computer to perform;

a first processor which outputs, to a customer, a list of multiple sets of voice characteristic data stored in the computer;

a second processor which outputs, to the customer, voice synthesis data that are obtained by employing voice characteristic data selected from the list by the customer to perform voice synthesis using text data entered by the customer; and a transmitter which reads the program from the storage device and transmits the program, whereby a service provider furnishes the customer, together with a list of multiple speakers from which one speaker can be selected by the customer, a list of devices into which the voice synthesis data can be loaded; whereby the customer notifies the service provider, via a network, which device was selected from the list; and whereby the service provider generates voice synthesis data based on the voice characteristic data of the speaker selected by the customer and loads the obtained voice synthesis data into the device selected by the customer.

13. A voice synthesis data storage medium, on which, when a customer connected via a network to a service provider submits a selected speaker chosen from a list of multiple speakers provided to the customer by the service provider via the network, and text data to the service provider, and when the service provider generates voice synthesis data in accordance with the selected speaker and the text data submitted by the customer, the voice synthesis data are stored, whereby the service provider furnishes the customer, together with the list of the speakers, a list of devices into which the voice synthesis data can be loaded; whereby the customer notifies the service provider, via the network, which device was selected from the list; and whereby the service provider generates voice synthesis data based on the voice characteristic data of the speaker selected by the customer and loads the obtained voice synthesis data into the device selected by the customer.

14. A voice output device comprising:

a storage unit, which stores voice synthesis data that are generated by a service provider, who retains in storage voice data for multiple speakers, based on a speaker and text data that are submitted via a network to the service provider; and a voice output unit which outputs a voice based on the voice synthesis data stored in the storage unit, whereby the service provider furnishes a customer, together with a list of multiple speakers from which one speaker can be selected by the customer, a list of devices into which the voice synthesis data can be loaded; whereby the customer notifies the service provider, via the network, which device was selected from the list; and whereby the service provider generates voice synthesis data based on the voice characteristic data of the speaker selected by the customer and loads the obtained voice synthesis data into the device selected by the customer.

15. A program storage device readable by machine, tangibly embodying a program of instructions executable by the machine to perform method steps for voice synthesis, said method comprising the steps of:

the service provider furnishing a list of the multiple speakers via the network to a remote user;

a customer transmitting to the service provider, via the network, an identity of a speaker that has been selected from the list, and text data for which voice synthesis is to be performed; and the service provider employing the voice characteristic data for the speaker selected by the customer to perform the voice synthesis using the text data, whereby the service provider furnishes the customer, together with the list of the speakers, a list of devices into which voice synthesis data can be loaded; whereby the customer notifies the service provider, via the network, which device was selected from the list; and whereby the service provider generates voice synthesis data based on the voice characteristic data of the speaker selected by the customer and loads the obtained voice synthesis data into the device selected by the customer.

* * * * *

UNITED STATES PATENT AND TRADEMARK OFFICE

CERTIFICATE OF CORRECTION

PATENT NO. : 6,983,249 B2
APPLICATION NO. : 09/891717
DATED : January 3, 2006
INVENTOR(S) : Huyen X. Vo It is certified that error appears in the above-identified patent and that said Letters Patent is hereby corrected as shown below:

Column 13, Line 56, “sneaker” should be --speaker--

Column 14, Line 57, “sneaker” should be --speaker--

Column 15, Line 12, “nerform” should be --perform--

Column 15, Line 50 “data;” should be --data,--

Signed and Sealed this

Tenth Day of April, 2007

JON W. DUDAS
*Director of the United States Patent and Trademark Office*